US010145574B2

(12) United States Patent
Graham

(10) Patent No.: US 10,145,574 B2
(45) Date of Patent: Dec. 4, 2018

(54) VENT PORT FOR A REFRIGERATED CABINET

(75) Inventor: Thomas Graham, Ocean, NJ (US)

(73) Assignee: COMPONENT HARDWARE GROUP, INC., Lakewood, NJ (US)

( * ) Notice: Subject to any disclaimer, the term of this patent is extended or adjusted under 35 U.S.C. 154(b) by 2630 days.

(21) Appl. No.: 12/653,242

(22) Filed: Dec. 10, 2009

(65) Prior Publication Data

US 2011/0143643 A1 Jun. 16, 2011

(51) Int. Cl.

| | |
|---|---|
| ***F24F 13/10*** | (2006.01) |
| ***F24F 13/18*** | (2006.01) |
| ***F24F 7/00*** | (2006.01) |
| ***F25D 17/04*** | (2006.01) |

(52) U.S. Cl.

CPC ..... *F24F 7/00* (2013.01); *F25D 17/047* (2013.01); *F24F 2007/003* (2013.01); *F24F 2221/34* (2013.01)

(58) Field of Classification Search

CPC .... F24F 7/00; F24F 2007/003; F24F 13/1406; F24F 13/143; F24F 11/022

USPC ..... 454/173, 238–245; 62/409, 410

See application file for complete search history.

(56) References Cited

U.S. PATENT DOCUMENTS 3,640,307 A * 2/1972 Drzala ..... 137/557
3,680,329 A * 8/1972 Burtis ..... 62/275
3,750,082 A * 7/1973 Petersen ..... H01C 1/1406 338/220
3,813,896 A * 6/1974 Lebahn ..... 62/409
3,839,982 A * 10/1974 Martin et al. ..... 114/74 R
3,918,231 A * 11/1975 Kessler ..... 52/844
3,952,542 A * 4/1976 Berkowitz ..... 62/409
4,086,780 A * 5/1978 Dienemann ..... 62/174
4,180,093 A * 12/1979 Kamezaki ..... 137/360
4,257,445 A * 3/1981 Cook et al. ..... 137/341
4,457,214 A * 7/1984 deVries ..... 454/255
4,499,917 A * 2/1985 Fujiya ..... 137/341
4,662,270 A * 5/1987 Fiddler et al. ..... 454/195
4,759,198 A * 7/1988 Yamada ..... 62/409
4,903,501 A * 2/1990 Harl ..... 62/187
4,951,555 A * 8/1990 Hahn et al. ..... 454/238
4,968,962 A * 11/1990 Hohider et al. ..... 337/4
5,296,678 A * 3/1994 Schnorf ..... 219/203
5,420,398 A * 5/1995 Petri et al. ..... 219/505
5,421,775 A * 6/1995 Honda ..... 454/274

(Continued)

FOREIGN PATENT DOCUMENTS

JP 09269183 A * 10/1997
JP 05 090287 * 5/2004

(Continued)

*Primary Examiner* — Steven B McAllister
*Assistant Examiner* — Frances F Hamilton
(74) *Attorney, Agent, or Firm* — Francis C. Hand; Carella, Bryne, et al

(57) ABSTRACT

The vent port employs a pair of mated housing parts that define a space for two flap valves. Each flap valve is formed of an aluminum bracket with an aperture for the passage of air and a silicone flap that closes over the aperture. The flap valves are oriented so that gravity enhances the closing of the flaps. Resistors are mounted on the brackets to heat the brackets at a low wattage. In one embodiment, the flap valves are vertically arranged over each other. In another embodiment, the flap valves are horizontally disposed in criss-crossing relation.

13 Claims, 5 Drawing Sheets

(56) References Cited

U.S. PATENT DOCUMENTS

| | | | | | |
|---|---|---|---|---|---|
| 5,836,170 | A | * | 11/1998 | Perkins et al. | 62/409 |
| 6,137,084 | A | * | 10/2000 | Thomas | 219/202 |
| 6,176,776 | B1 | * | 1/2001 | Finkelstein et al. | 454/195 |
| 6,672,094 | B1 | * | 1/2004 | Carden et al. | 62/273 |
| 6,672,096 | B2 | * | 1/2004 | Lopes | 62/331 |
| 6,769,263 | B1 | * | 8/2004 | Armour et al. | 62/187 |
| 7,716,945 | B2 | * | 5/2010 | Weng | 62/440 |
| 7,861,540 | B2 | * | 1/2011 | Cloutier et al. | 62/63 |
| 8,651,924 | B1 | * | 2/2014 | Jones et al. | 454/71 |
| 2003/0064002 | A1 | * | 4/2003 | Jaworski et al. | 422/28 |
| 2005/0081555 | A1 | * | 4/2005 | Seiss | 62/410 |
| 2007/0187145 | A1 | * | 8/2007 | Periard | 175/18 |
| 2007/0261426 | A1 | * | 11/2007 | Cho et al. | 62/340 |
| 2008/0235998 | A1 | * | 10/2008 | Yeung et al. | 38/93 |
| 2009/0205283 | A1 | * | 8/2009 | Wang Chen | 52/592.1 |
| 2009/0273265 | A1 | * | 11/2009 | Aragon | 312/405 |
| 2009/0312676 | A1 | * | 12/2009 | Rousso et al. | 601/15 |

FOREIGN PATENT DOCUMENTS

| | | | | |
|---|---|---|---|---|
| JP | 09 269183 | | * | 3/2008 |
| JP | 05090287 | A | * | 4/2008 |
| JP | 2009174736 | A | * | 8/2009 |

* cited by examiner

VENT PORT FOR A REFRIGERATED CABINET

This invention relates to a vent port for a refrigerated cabinet, such as refrigerated coolers and freezers.

As is known, vent ports have been used on large coolers and freezers in order to equalize the atmospheric pressure inside the units. As the air inside a cooler or freezer drops in temperature, the air contracts causing a slight vacuum relative to the air pressure outside of the unit. The vent port permits a controlled amount of outside air to enter the unit as the air contracts; typically, by means of an elastomeric "flap" valve or a spring loaded or weight loaded rigid valve in order to equalize the pressure. This type of valve also permits air to enter as the door to the unit is pulled open making the door easier to open.

Additionally, if two oppositely directed valves are used, the vent port will also permit air to be let out as the door of the cooler or freezer is closed in addition to allowing air in as the door is opened, thus decreasing the operator effort to use the door.

Since these valves are at an interface of the cold inside air and the warmer outside air, moisture condensate often develops at the valve, particularly, if the valve is not tightly closed. This condensate can freeze and the resulting ice prevents operation of the valves. In order to prevent this, a heating means is located on or adjacent to the valves. The type of heater most commonly used is a silicone rubber pad with a very small diameter resistance wire imbedded in the pad.

However, the silicone rubber pads that have been used for heating the valves have a high reject rate and often fail prematurely. Additionally, these pads are usually custom made for the application which makes the pads relatively expensive. Further, the limited shape possibilities of this type of pad prevents the optimal placement where the heat is needed resulting in heat being wasted and higher wattage being used to compensate for this, thus wasting electricity.

Accordingly, it is an object of the invention to provide a vent port for a refrigerated cabinet of economical construction.

It is another object of the invention to provide a vent port for a refrigerated cabinet that is of small compact construction.

It is another object of the invention to provide a vent port that may be efficiently operated.

It is another object of the invention to provide a vent port for a refrigerated cabinet that employs a low wattage heater.

Briefly, the invention provides a vent port for a refrigerated cabinet that utilizes a flap of resilient material for opening and closing of the valve through which the passage, or not, of air may be controlled.

In accordance with the invention, a means is provided in the vent port for heating of the vent port and flap so as to preclude the formation of ice. This means is in the form of a metal bracket that has an aperture for the passage of air from one side of the vent port to the opposite side and a resistor mounted on the bracket for generating and delivering heat into the bracket sufficient to melt ice thereon.

The flap of resilient material is mounted on the bracket over the aperture to close the aperture and to lift from the bracket to open the aperture.

The bracket is mounted in a housing of the vent port and the flap is secured at one end to the bracket for movement between a first position in abutment with the bracket in order to close the aperture and a second position spaced from the aperture in order to allow the passage of air therethrough.

The flap is disposed on the bracket for movement under gravity from the open position to the closed position.

The resistor is mounted in a channel that is formed by a lower end of the bracket for generating and delivering heat into the bracket. The resistor is of a type that uses a low wattage, for example, 4 watts at 120 volts, that is sufficient to heat the bracket so that moisture that forms on the bracket about the aperture during use does not freeze and interfere with the operation of the flap.

In one embodiment, the vent port is constructed for placement vertically within a door of a refrigerated cabinet. In this embodiment, the housing is sized to fit within a door jamb of the refrigerated cabinet and is formed of a pair of plastic parts that are secured together in mating relation to define a space therebetween. In addition, a pair of the brackets is mounted in the housing with each bracket having an aperture for the flow of air, one aperture for the flow of air into a cabinet and the other for a flow of air in an opposite direction out of a cabinet. The brackets are disposed in vertical alignment relative to each other with each bracket disposed at an acute angle relative to a vertical plane. Flaps are disposed on the respective brackets for movement under gravity from the open position to the closed position.

In addition, a pair of louvered end covers are secured across the plastic parts of the housing in order to close the space within which the brackets are located. Each end cover is also provided with a peripheral lip to engage against a side of the door jamb to seal the housing of the vent port. Each lip has holes for the passage of screws or the like to allow the end cover to be secured to the door jamb so as to locate the housing within the door jamb.

In another embodiment, the vent port is constructed for placement horizontally within a door of a refrigerated cabinet. In this embodiment, the vent port has a box-shaped housing that defines a chamber and a pair of metal brackets mounted in the housing in side-by-side criss-crossing relation to separate one side of the chamber from an opposite side of the chamber. As above, each bracket has an aperture for a flow of air from one of the sides of the chamber to the other side of the chamber. In addition, the vent port has a pair of flaps, each of which is mounted on a respective bracket in overlying relation to an aperture for movement between a first position in abutment with the bracket to close the aperture to the passage of air from one side of the chamber to the other side of the chamber and a second position spaced from the aperture to allow passage of air therethrough.

Also, this vent port has a pair of resistors, each of which is mounted on a respective bracket for generating and delivering heat into the bracket sufficient to melt ice thereon.

In all embodiments, the vent port is of relatively narrow construction and by mounting on the door jamb, can be conveniently visible for inspection and to facilitate wiring of the vent port resistors.

These and other objects and advantages of the invention will become more apparent from the following detailed description taken in conjunction with the accompanying drawings wherein.

Figure 1:
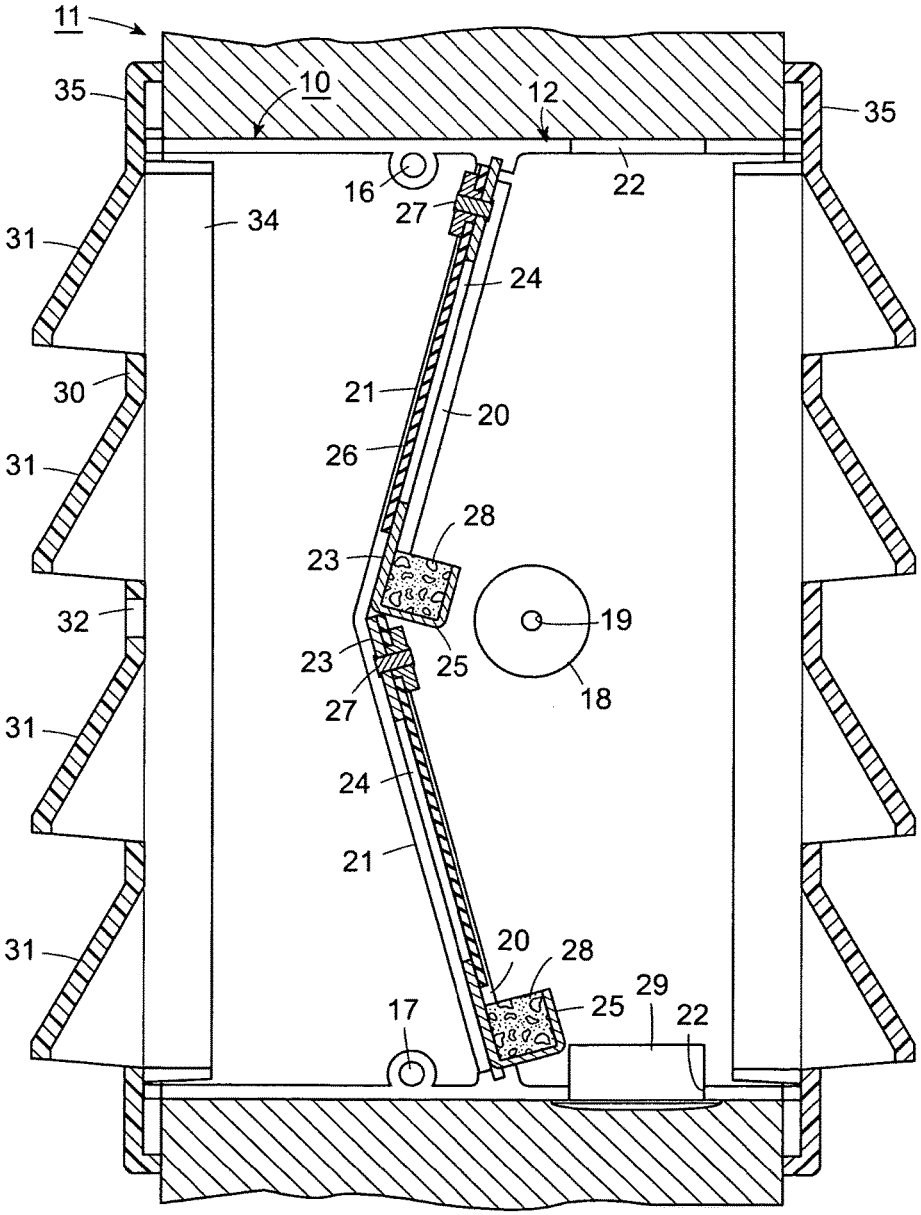
FIG. 1 illustrates a cross-sectional view of a vent port mounted in a door jamb in accordance with the invention.

Referring to FIG. 1, the vent port 10 is mounted in a door jamb 11 of a door of a refrigerated cabinet, such as a refrigerated cooler or freezer (not shown).

The vent port 10 has a housing 12 that is sized to fit within the door jamb 11.

Figure 3:
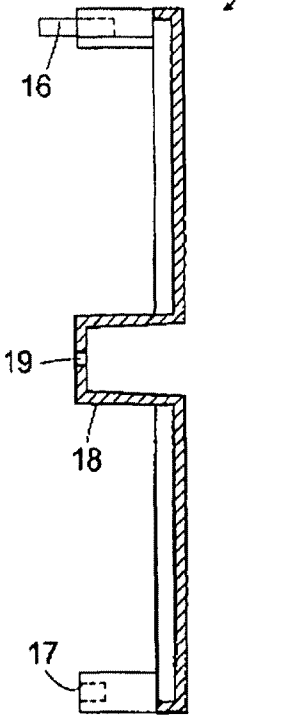
FIG. 3 illustrates part a cross-section view taken on line 3-3 of FIG. 2.
Figure 8:
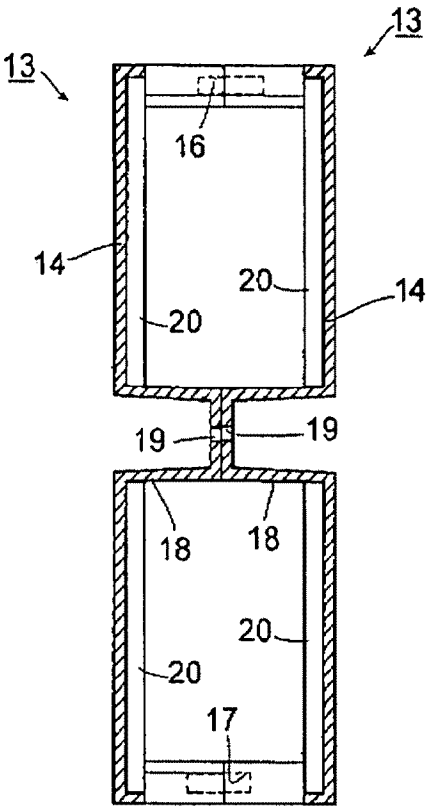
FIG. 8 illustrates a cross-sectional view of a vent port formed of a pair of parts without the brackets in place.

As shown in FIGS. 3 and 8, the housing 12 is formed of a pair of plastic parts 13 that are secured together in mating relation to define a space therebetween.

Figure 2:
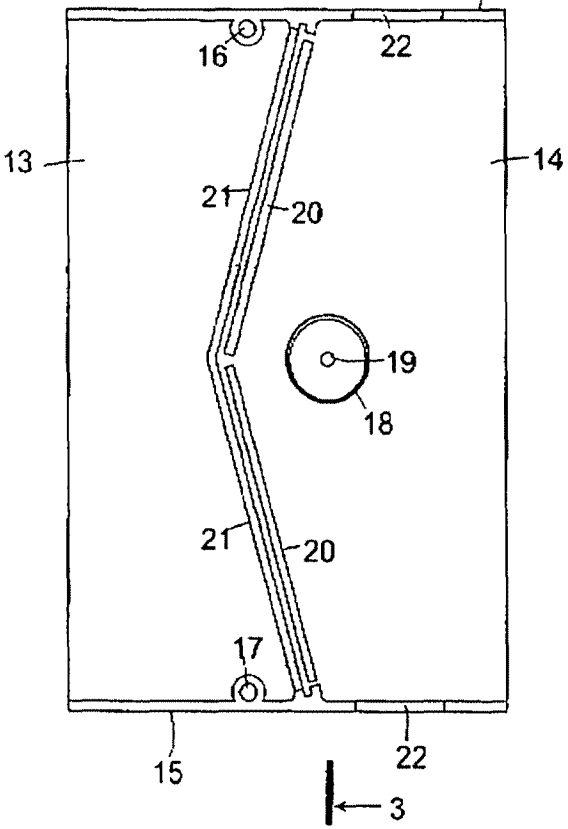
FIG. 2 illustrates a front view of a housing part constructed in accordance with the invention.

Referring to FIGS. 2 and 3, each housing part 13 is sized to fit into the door jamb 11 (see FIG. 1) and each has a flat wall 14 of rectangular shape and a pair of oppositely disposed flanges 15 on the wall to define a channel-shaped cross-section. One flange 15 carries a pin 16 for sliding into a bore 17 in the other flange 15 in order to mate the parts together.

As illustrated in FIG. 8, the wall 14 of each housing part 13 is provided with an enlarged boss 18 that projects toward the other housing part 13 and has an aperture 19 through which a securing means, such as a screw, may be passed for securing the two housing parts 13 together. In addition, the wall 14 of each housing part 13 is provided with two pairs of integral walls 20, 21 (see FIG. 2) that define a slot therebetween and that project from the wall 14 approximately 0.188 inch.

Each flange 15 of the housing part 13 is provided with a semi-circular recess 22 for the passage of an electrical line.

Referring to FIG. 1, the vent port 10 is also provided with a pair of brackets 23 that are made of a heat conducting metal, such as, aluminum, and that are mounted in the slots between the walls 20, 21 of the housing 12 in vertical alignment relative to each other, as viewed. Each bracket 23 is disposed at an acute angle relative to a vertical plane.

Each bracket 23 is of rectangular construction and is of a width to fit between the respective walls 20, 21 of each housing part 13. In addition, each bracket 23 has an aperture 24, for example, of rectangular shape for the passage of air, and a bottom edge that is turned upwardly in order to define a channel 25.

The vent port 10 also has a pair of flaps 26, each of which is mounted on a respective bracket 23 in overlying relation to the aperture 24 therein for movement between a first position, as shown, in abutment with the bracket 23 in order to close the aperture 24 and a second position (not shown) spaced from the aperture 24 to allow passage of air therethrough.

Each flap 26 is of a shape compatible with the shape of the aperture 24 in order to close the aperture 24 to the flow of air when the flap 26 is in the closed position. For example, each flap 26 is of rectangular shape and is secured by a pair of rivets 27 to an upper section of the respective bracket 23. Each flap 26 is made of silicone rubber and acts as a closure valve over the venting aperture 24.

The vent port 10 also has a pair of resistors 28, each of which is mounted in a channel 25 of a respective bracket 23 for generating and delivering heat into the bracket 23 sufficient to melt ice thereon. Each resistor 28 is of a metallic element type that uses a low wattage, for example 4 watts at 120 volts. This type of resistor is called "flame proof" and/or "sand block" or "cement" in the electronics field. The resistors 28 are off the shelf items and are widely used in the electronics industry. Each resistor 28 consists of a rectangular ceramic body into which is placed a wound wire or a metal film resistor element and then sealed shut with a ceramic potting mixture.

The resistors 28 are mounted in the channels 25 of the brackets 23 and heat the brackets 23 because of the power they dissipate. Thus, the heat is applied more precisely to where the heat is needed and less wattage is required and less heat is wasted.

The lower flap 26 is mounted on the lower bracket 23 on the same side as the resistor 28 and opens to relieve higher pressure inside the cooler as the door is closed. The upper flap 26 on the upper bracket 23 is mounted on the side opposite to the resistor 28 and opens in the opposite direction to relieve a lower pressure as the cooler door is opened and also as the air in the cooler contracts. The arrangement of the flaps is such that gravity assists in keeping the flap valves closed.

In order to assemble the vent port 10, the brackets 23 are first positioned in the slots between the walls 20,21 of one housing part 13. Thereafter, the second housing part 13 is fitted into place on the first housing part 13 via the pins 16 and recesses 17 while positioning the brackets 23 in the slots defined by the walls 20,21 thereon. Next, a screw (not shown) is passed through the aperture 19 in one of the bosses 18 into a nut (not shown) received in the boss 18 of the other housing part to secure the two parts together. Alternatively, a single screw may be threaded into the second part 12 (not shown).

When the two housing parts 13 are mated, the recesses 22 define an aperture, for example of ⅞ inch diameter, at the top and bottom of the vent port 10. Either aperture may accept a standard one-half inch electrical conduit or a grommet (not shown). The unused aperture is then plugged with a suitable plug closure 29.

The electrical line that is fit into the aperture 22 passes through the door jamb 11 in a suitable manner from a power source (not shown) and is connected in the suitable manner to the resistors 28 in order to deliver electrical energy thereto.

Referring to FIG. 1, a pair of louvered end covers 30 are fitted into the housing parts 13 and secured to opposite sides of the door jamb 11.

Figure 4:
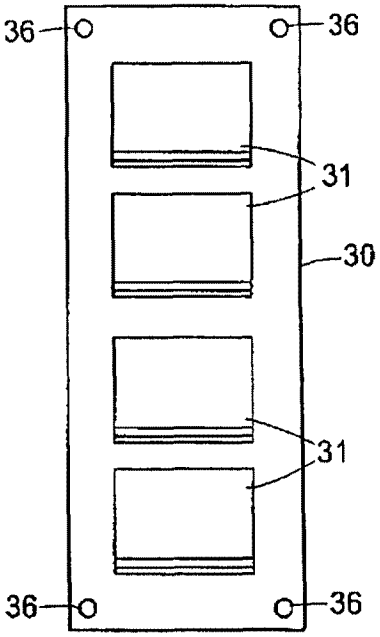
FIG. 4 illustrates a front view of louvered end cover in accordance with the invention.

Referring to FIG. 4, each louvered end cover 30 is of generally rectangular shape and has a plurality of louvers 31, for example four, which are vertically disposed relative to each other.

Each end cover 30 has a peripheral flange 34, for example, of a height of 0.329 inches, that projects into and between the housing parts 13 and a peripheral lip 35 that abuts against the door jamb 11. The lip 35 is provided with holes 36 in the four corners to facilitate securement of the end covers 30 to the door jamb 11 via screws (not shown).

Figure 5:
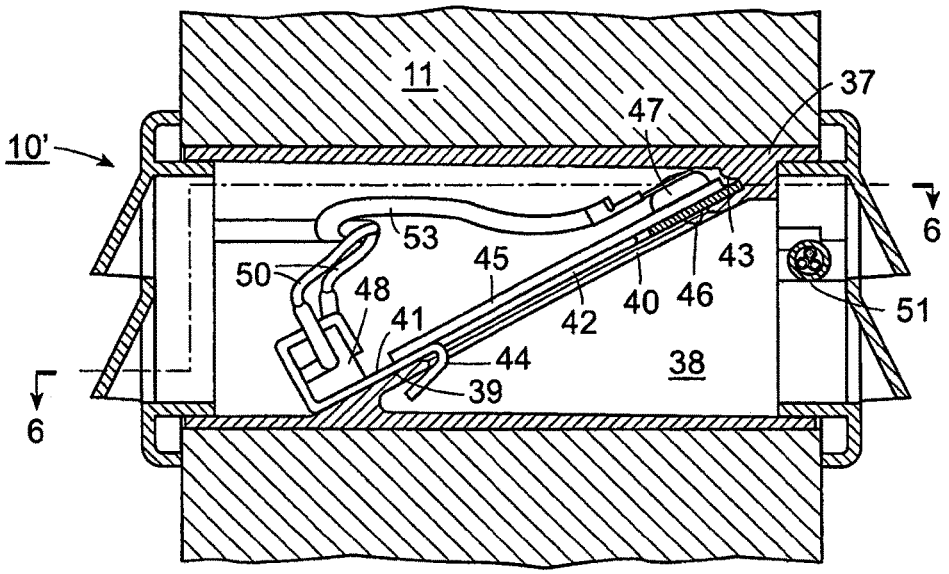
FIG. 5 illustrates a cross-sectional view of a modified vent port with criss-crossing brackets in accordance with the invention.
Figure 6:
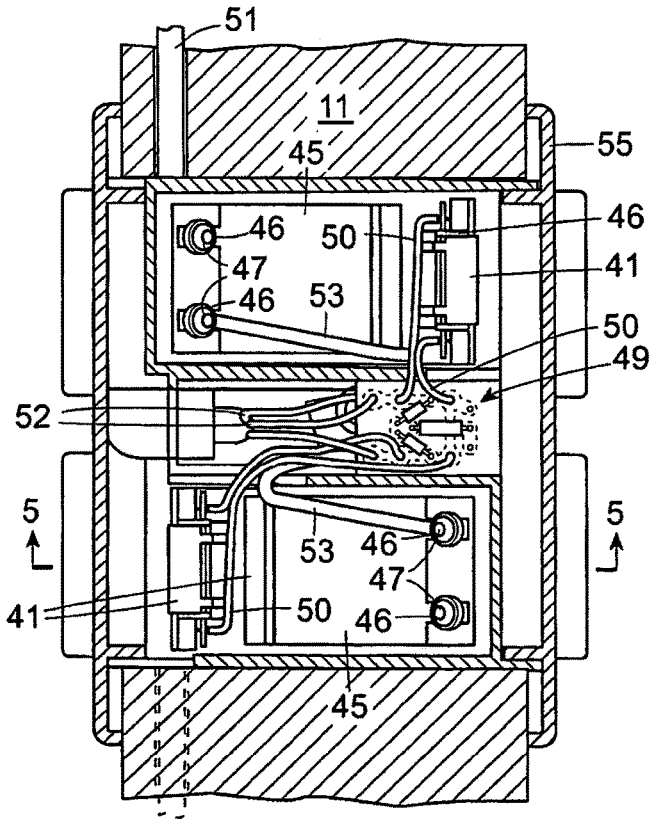
FIG. 6 illustrates a view taken on line 6-6 of FIG. 5.

Referring to FIGS. 5 and 6, wherein like reference characters indicate like parts as above, the vent port 10' is mounted in a door jamb 11 in a horizontal manner.

The vent port 10' includes a box-shaped housing 37, for example, made of molded plastic, that defines a chamber 38. As indicated, the housing 37 extends throughout the thickness of the door jamb 11.

Referring to FIG. 6, the housing 37 has a pair of integral partition walls 39 disposed in side-by-side criss-crossing relation within the chamber 38. As indicated in FIG. 5, each partition wall 39, only one of which is shown, has an aperture 40 for the passage of air from one side of the chamber 38 to the opposite side.

A metal bracket 41 is mounted on each partition wall 39 and has an aperture 42 aligned with the aperture 40 in the partition wall 39. In order to hold the bracket 41 firmly in place on the partition wall 39, the upper edge of the bracket 41 is inserted within a notch 43 in the housing 37 and a lower end of the bracket 41 has a bent over tang 44 that extends through the aperture 42 and fits against the underside of the partition wall 39.

Referring to FIG. 5, a resilient flap 45, for example made of rubber, is mounted on each bracket 41 in overlying relation to the aperture 40 for movement between a first position in abutment with the bracket 41 in order to close the aperture 42 to passage of air from one side of the chamber 38 to the opposite side of the chamber 38 and a second position (not shown) spaced from the aperture 42 to allow the passage of air from one side of the chamber 38 to the other side of the chamber 38. The upper end of each flap 45 is secured by a pair of rivets 46 to the bracket 41 via a respective bushing 47 so that the lower end of the flap 45 may lift from the bracket 41 when there is a differential air pressure across the openings 40, 42 and flap 45.

In addition, a resistor 48 is mounted on the bracket 41 for generating and delivering heat into the bracket 41 sufficient to melt ice thereon. As illustrated, the bracket 41 is bent over at the lower end in order to mount the resistor 48 on the lower end of the bracket 41.

Each flap 45 is disposed for movement under gravity from the open position to the closed position. With the flaps 45 disposed in criss-crossing relation as indicated in FIG. 6, air may pass through the vent port 10' from opposite sides of the door jamb 11.

Referring to FIG. 6, a printed circuit board 49 is mounted within the housing 37 within a space between the partition walls 39. This circuit board 49 carries separate circuits for the two resistors 48 and is electrically connected to the respective resistors 48 by suitable electrical lines 50 in order to energize each resistor from a common power cord 51 (see FIG. 5). Both circuits are connected to the power cord 51 via suitable lines 52 (see FIG. 6).

A ground wire 53 is also connected via one of the rivets 46 to each bracket 41. As shown in FIG. 5, each rivet 46 passes through a terminal end of the ground wire 53, a bushing 47, a flap 45 and a bracket 41.

Figure 7:
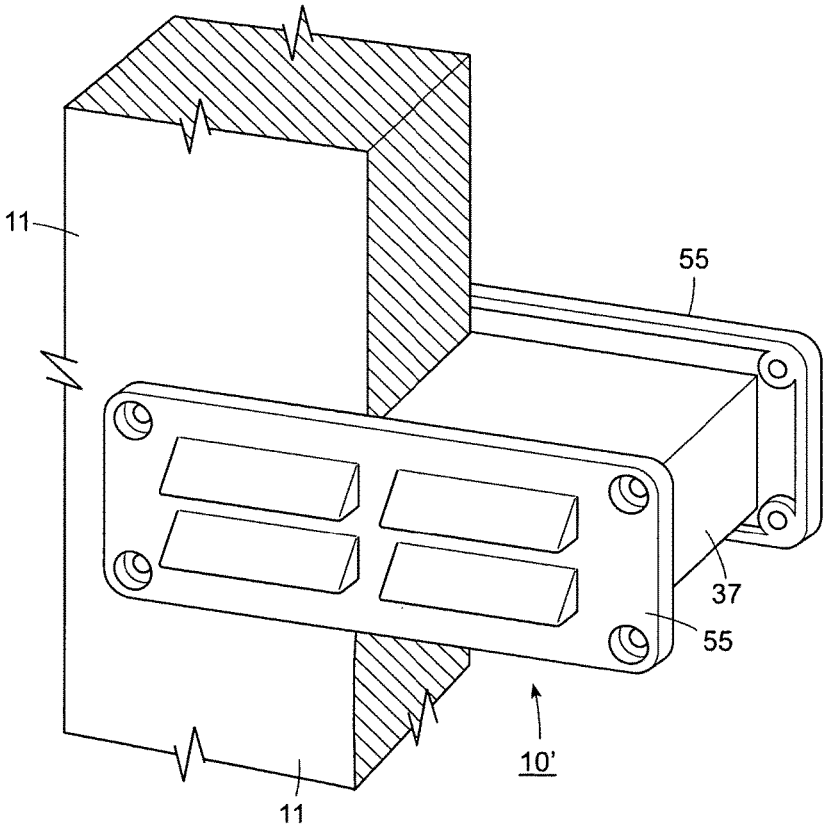
FIG. 7 illustrates a part perspective view of the vent port of FIG. 5 in a door jamb.

Referring to FIGS. 5 and 7, the vent port 10' includes a pair of louvered end covers 55, which are mounted on opposite ends of the housing 37 and secured to opposite sides of the door jamb 11, as above described.

Referring to FIGS. 5 and 6, the power cord 51 passes through the door jamb 11 and into the housing 37 to connect with the printed circuit board 49.

The power cord 51 may include a swivel assembly (not shown) that allows the power cord 51 to be let out through one or the other sides of the housing 37.

When in use, should the air within a refrigerated cabinet, for example, to the right hand side of FIG. 5, become cold thereby creating a partial vacuum, ambient air at a higher pressure on the outside of the cabinet lifts the upper flap 45, as viewed in FIG. 6, so that the ambient air may flow into the refrigerated cabinet. Upon closing of the door, pressurized air within the refrigerated cabinet lifts the lower flap 45, as viewed in FIG. 6, so that air may escape from the refrigerated cabinet.

The invention thus provides a vent port 10 of relatively narrow construction that can be mounted on the door jamb 11.

The invention also provides a vent port that is able to use resistors of low wattage thereby rendering the vent port efficient and economical in the use of electrical energy.

The invention further provides a vent port that can be easily fabricated, installed in the door of a refrigerated cabinet and maintained in use.

What is claimed is:

1. A vent port for a refrigerated cabinet comprising at least one heat conducting metal bracket of rectangular construction having an aperture therein for a flow of air therethrough and an upwardly turned edge defining a channel along a bottom edge thereof;

a flap of resilient material mounted on said bracket in overlying relation to said aperture for movement between a first position in abutment with said bracket and above said channel to close said aperture and a second position spaced from said aperture to allow passage of air therethrough; and a resistor mounted in said channel of said bracket below said flap for generating and delivering heat into said bracket sufficient to melt ice thereon, said resistor having a rectangular ceramic body mounted in said channel.

2. A vent port as set forth in claim 1 wherein said flap is made of silicone rubber.

3. A vent port as set forth in claim 1 wherein said flap is secured at one end to said bracket and is free to flex away from said aperture relative to said one end.

4. A vent port for a refrigerated cabinet comprising a housing formed of a pair of vertically disposed plastic parts secured together in mating relation to define a space therebetween;

a pair of brackets mounted in said housing transversally of said space, each said bracket having an aperture therein for a flow of air therethrough and a channel along a bottom edge thereof;

a pair of flaps, each said flap being mounted on a respective bracket of said pair of brackets in overlying relation to said aperture therein for movement between a first position in abutment with said respective bracket to close said aperture therein and a second position spaced from said aperture to allow passage of air therethrough; and a pair of resistors, each said resistor having a rectangular ceramic body mounted in said channel on a respective bracket of said pair of brackets below a respective flap of said pair of flaps for generating and delivering heat into said respective bracket sufficient to melt ice thereon.

5. A vent port as set forth in claim 4 wherein said brackets are disposed in vertical alignment relative to each other, and wherein each said bracket is disposed at an acute angle relative to a vertical plane.

6. A vent port as set forth in claim 5 wherein one of said flaps is disposed on one side of one of said brackets for movement under gravity from said second position thereof into said first position thereof and the other of said flaps is disposed on an opposite side of the other of said brackets for movement under gravity from said second position thereof into said first position thereof.

7. A vent port as set forth in claim 5 further comprising a pair of louvered end covers secured across said plastic parts to close said space.

8. A vent port as set forth in claim 5 further comprising an opening in at least one of said housing parts for passage of an electrical line to at least one of said resistors.

9. A vent port as set forth in claim 4 wherein each said vertically disposed plastic part has two pairs of integral walls projecting therefrom into said space, each said pair of walls defining a slot therebetween and receiving a respective bracket of said pair of brackets.

10. In combination, a door jamb for a refrigerated cabinet;

a vent port mounted in said door jamb and including a housing formed of a pair of vertically disposed plastic parts secured together in mating relation to define a space therebetween;

a pair of brackets mounted in said housing transversally of said space, each said bracket having an aperture therein for a flow of air therethrough and an upwardly turned edge defining a channel along a bottom edge thereof;

a pair of flaps, each said flap being mounted on a respective bracket of said pair of brackets in overlying relation to said aperture therein for movement between a first position in abutment with said respective bracket to close said aperture therein and a second position spaced from said aperture to allow passage of air therethrough; and a pair of resistors, each said resistor having a rectangular ceramic body mounted in said channel on a respective bracket of said pair of brackets below a respective flap of said pair of flaps for generating and delivering heat into said respective bracket sufficient to melt ice thereon; and a pair of louvered end covers secured across said housing and secured to opposite sides of said door jamb.

11. The combination as set forth in claim 10 wherein said brackets are disposed in vertical alignment relative to each other, and wherein each said bracket is disposed at an acute angle relative to a vertical plane.

12. The combination as set forth in claim 11 wherein one of said flaps is disposed on one side of one of said brackets for movement under gravity from said second position thereof into said first position thereof and the other of said flaps is disposed on an opposite side of the other of said brackets for movement under gravity from said second position thereof into said first position thereof.

13. A vent port for a refrigerated cabinet comprising a housing formed of a pair of vertically disposed plastic parts secured together in mating relation to define a space therebetween;

a pair of heat conducting metal brackets mounted in said housing transversally of said space and in vertical alignment relative to each other, each said bracket being disposed at an acute angle relative to a vertical plane and having an aperture therein for a flow of air therethrough and an upwardly turned edge defining a channel along a bottom edge thereof;

a pair of flaps of silicone rubber, each said flap being mounted on a respective bracket of said pair of brackets in overlying relation to said aperture therein for movement between a first position in abutment with said respective bracket to close said aperture therein and a second position spaced from said aperture to allow passage of air therethrough; and a pair of resistors, each said resistor having a rectangular ceramic body with one of a wound wire and a metal film resistor element sealed therein and mounted in said channel of a respective bracket of said pair of brackets for generating and delivering heat into said respective bracket sufficient to melt ice thereon.

* * * * *